United States Patent [19]

Berghgracht

[11] 3,997,054

[45] Dec. 14, 1976

[54] WATERTIGHT PACKAGE APPARATUS

[76] Inventor: Marius Leopold Hypolite Berghgracht, Place Joyale Vineuil-sur-Firmin pres Chantilly, Chantilly (Oise), France

[22] Filed: Mar. 3, 1975

[21] Appl. No.: 554,557

[30] Foreign Application Priority Data

June 15, 1971 Luxembourg.....63337

Related U.S. Application Data

[63] Continuation-in-part of Ser. No. 397,316, Sept. 5, 1973, abandoned.

[52] U.S. Cl. ..... 206/386; 206/497; 229/DIG. 12

[51] Int. Cl.[2] ..... B65D 19/00; B65D 71/00

[58] Field of Search ..... 206/386, 497, 45.33; 229/DIG. 12

[56] References Cited

UNITED STATES PATENTS

| | | | |
|---|---|---|---|
| 3,522,688 | 8/1970 | Kaliwoda et al. | 206/386 |
| 3,667,598 | 6/1972 | Zelnick et al. | 206/386 |
| 3,788,462 | 1/1974 | Meincer | 206/497 |
| 3,853,218 | 12/1974 | Grasvoll | 206/497 |
| 3,858,526 | 1/1975 | Lombard | 206/497 |

*Primary Examiner*—William T. Dixson, Jr.
*Attorney, Agent, or Firm*—Sherman Levy

[57] ABSTRACT

A watertight package disposed about one or more articles in such a manner that the package can be easily handled by conventional article handling equipment. The package includes a first thermoplastic sheet attached to a pair of disposable support members and on which one or more articles are placed and thereafter a second thermoplastic sheet is draped over the articles and sealed to the first sheet while such sheets are shrunk into intimate engagement with the articles.

2 Claims, 3 Drawing Figures

WATERTIGHT PACKAGE APPARATUS

This application is a continuation-in-part application of Ser. No. 397,316, filed Sept. 5, 1973 now abandoned.

FIELD OF THE INVENTION.

The invention relates to a package apparatus of any type, such as cement bags, beer or oil cases, food products or any other items likely to constitute a geometric volume suitable for stacking in which such items are completely surrounded by a watertight covering and are supported in a manner to be easily handled by conventional load handling equipment.

DESCRIPTION OF THE PRIOR ART.

It is conventional in the industry to place a plurality of articles on a pallet in a desired order to provide a package having a volume which can be easily handled by means of a fork lift or the like. It is also conventional to wrap such a package with a covering made from a retractable film so that bundling or strapping operations by means of steel or plastic ribbons are unnecessary. Although these packages have been an improvement over what was formerly made, they have the drawback of not completely and tightly sealing the package, which can be detrimental to the wrapped products, particularly if the product is food or any other perishable product which must necessarily be protected from dampness.

Furthermore, since such packages have been of relatively high cost, some efforts have been made to construct the pallets of cheap materials so that they may be regarded as disposable. However, these pallets, in spite of their low cost, have considerably raised the cost of the packages which resulted in increasing the price of products delivered to the consumers.

SUMARY OF THE INVENTION .

The invention is embodied in a compact watertight package which can be handled by means of lifting apparatus, wherein a first sheet of thermoplastic material is glued to a pair of shaped pieces, then the products to be packed are placed on the first sheet so as to form a polyhedric volume, preferably cubical, and then the upper portions of the products are covered by a second sheet made of a heat shrinkable thermoplastic material which is substantially higher than the upper portion of the products. The edges of the two thermoplastic sheets are connected together, and the package is introduced into a furnace which causes the edges of the sheets to be welded together and causes the sheets to shrink into intimate engagement with the articles to form a waterproof package.

It is an object of the invention to provide a waterproof package having a first thermoplastic sheet mounted on a pair of support members, one or more articles on the first sheet, a second thermoplastic sheet draped over the article, and the thermoplastic sheets are welded together while such sheets are caused to shrink into intimate engagement with the article.

Figure 1:
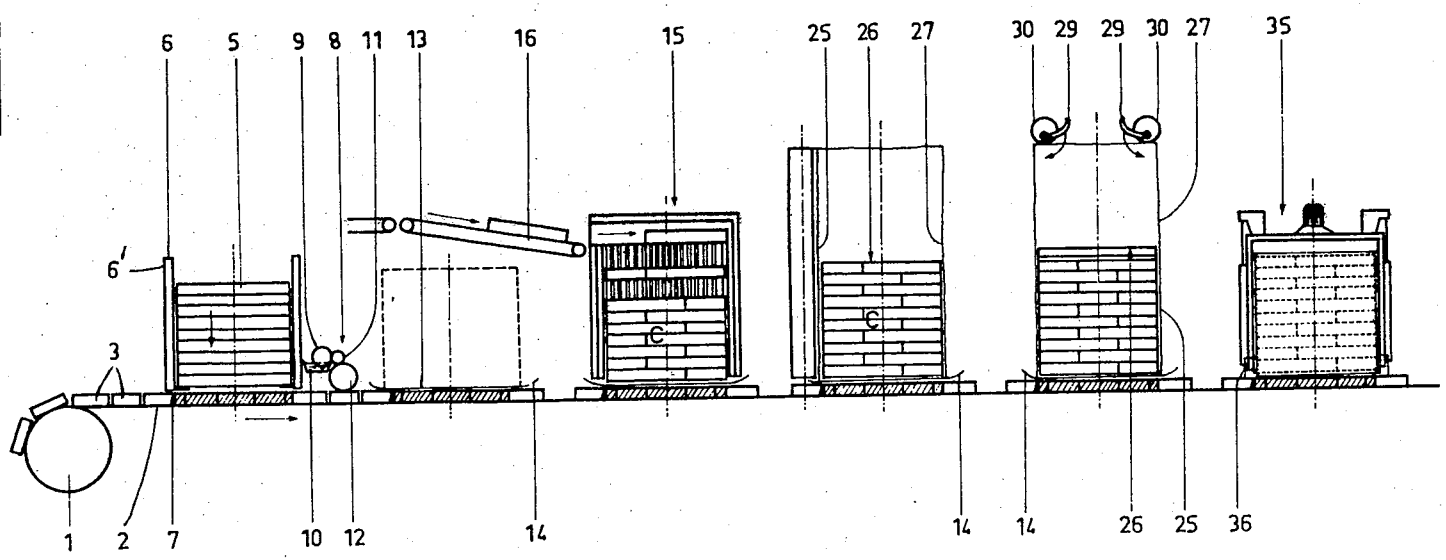
FIG. 1 is a schematic side elevation illustrating one embodiment of the invention.

With continued reference to the drawings, the invention includes a conveyor unit 1, having a belt 2 passing through a series of operating stations. The conveyor belt 2 has on its upper surface three rows of transversely spaced, upstanding segmented units 3 in spaced end to end relationship with each other and forming continuous channels or spaces 4 which receive feet or support members 5. These feet are located generally parallel to each other within the channels 4 and are spaced apart a distance substantially corresponding to the distance between the two arms of a fork lift apparatus. Although the feet or support members 5 may have either a closed or open section without changing the principle of the invention, such feet are preferably of hollow tubular construction of a size to receive the forks of a fork lift or the like. The feet 5 must be at least as high as units 3 for reasons which will be described later on. Such feet can be made of any material, for example, of molded plastic materials, wood or the like. Due to their low cost, the feet can be regarded as disposable or, if desired, can be recovered and reused.

The conveyor belt passes first through a feeding station 6 having guides 6' within which the feet 5 are piled in two generally vertical stacks and such feet are located in a plane generally parallel to the direction of movement of the conveyor belt. At the feeding station, the lower most foot of each stack is engaged by upstanding lugs 7 carried by the conveyor belt and disposed in a position to move through the channels 4. The lugs 7 move the lowermost feet out of the feeding station 6 while the remainder of the stacks of feet are retained in position by the guides 6'. After the lowermost feet have been moved, the stacks drop down by gravity so that the conveyor is in a position to be engaged by the next set of lugs 7.

The feet which are removed from the feeding station are carried by the belt 2 to a glueing station 8. The glueing station includes a first roll 9 rotating in a glue container 10 for picking up therefrom a film of glue, a second roll 11 for receiving glue from the first roll and transmitting this film of glue to a third roll 12 which contacts the upper face of the feet 5. The rolls may either have a width corresponding to that of the feet 5 so as not to glue the upper face of the units 3 or may have a width equal to that of the conveyor belt; but, in that case, the height of the units must be slightly lower than the height of the feet.

The feet, thus glued and driven by the lugs 7, pass through a base applying station where a base sheet 13 is placed on the feet 5. This base sheet can be a retractable thermoplastic material or a flexible material coated with plastic. The base sheet 13 is glued to the feet 5 and has a larger surface than the actual lower surface of the package to be obtained so that the peripheral border 14 of the base sheet subsequently can be fixed to the vertical walls of the cover surrounding the package. When the base sheet 13 is in position, the conveyor belt is started again so that the base sheet is moved to a loading station 15.

At this station, the package (generally referenced C) is made by piling successive layers of the articles, according to a rational schedule similar to masonry. This loading can be accomplished, as shown in FIG. 1, by means of a conveyor belt 16 feeding succssive layers of articles onto the base sheet 13, unitl the desired volume is completed.

This volume is necessarily polyhedric, for example cubic, and it is to be noted that the stopping time of the conveyor belt is equal to the time necessary for makig a package by means of the loading apparatus.

Figure 3:
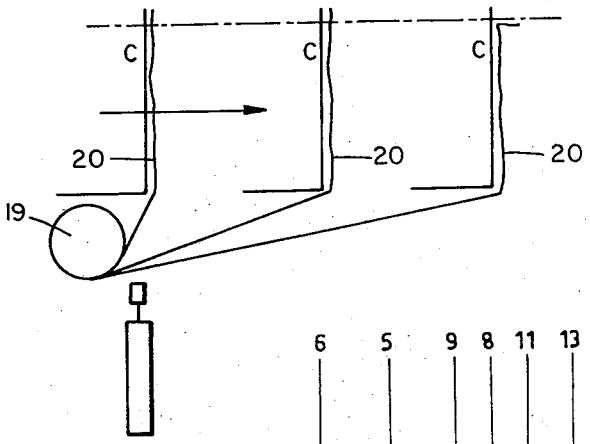
FIG. 3 is a schematic side elevation showing the steps of forming the peripheral portions of a package.
Figure 2:
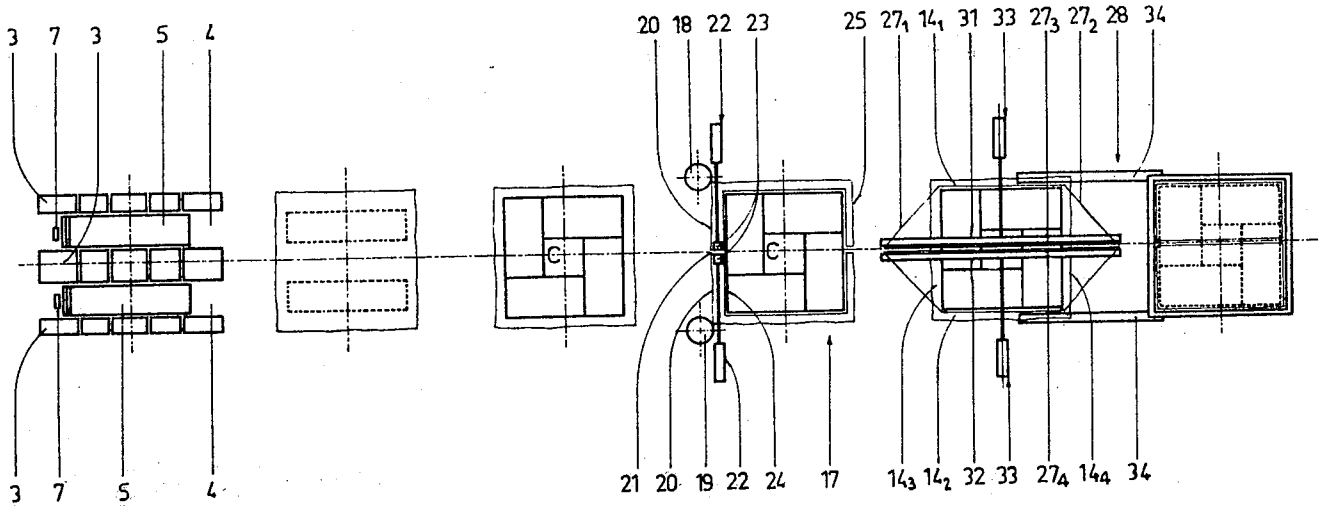
FIG. 2 is a top plan view thereof.

The base sheet 13 and the stacked articles are then carried to a covering station 17 (FIG. 2) where a peripheral covering is formed around the articles. This covering is made from two rolls 18 and 19, located on opposite sides of the conveyor belt and which extends upwardly substantially above the stack of articles. Each of the rolls 18 and 19 unwinds a film of retractable or heat shrinkable plastic material 20, whose vertical edges are connected together at 21, so as to form a transverse screen obstructing the passage of the package carried by the conveyor belt. When the package reaches this screen, such package carries the screen forward, as shown in FIG. 3, thus unwinding the plastic film from rolls 18 and 19 until the unwound length is sufficient for completely surrounding the four vertical walls of the package.

A pair of lateral jacks 22 are located on opposite sides of the conveyor belt and each of such jacks includes heating jaws for welding the covering. These jacks engage the sides of the plastic material films and are extended inwardly so that such plastic films surround the back face 24 of the package to fully close the loop surrounding the four vertical walls of the said package. When the loop is thus closed, the heating jaws 23 weld the opposed portions of the film to each other, after which knives (not shown) cut the welded zone along a vertical plane so as to form again a screen for the next package to come. Of course, the jacks 22 and the heating jaws 23 are actuated by contacts which are energized by the displacement of the package.

The peripheral covering 25 surrounds the package, (FIG. 1), and extends above the upper level 26 of the package so that the upper border 27 subsequently may be used to form its upper face. The border 27 must at least have a height equal to a half-width of the package, in addition to the width necessary for welding the two horizontal edges of the covering.

The package, thus wrapped, is moved by the conveyor belt to a top forming station 28 where the top of the covering is closed. At this station, the peripheral border 27 of the covering is turned down and folded on the top 26 of the package by means of fingers 29 which are integral with eccentric cams 30. Such fingers, by pivoting towards the exterior, move the two opposite edges $27_1$ and $27_2$ of the border of the covering away from each other in order to form two triangle-shaped bellows, which places the two other edges $27_3$ and $27_4$ of the covering opposite in engagement with each other so that they can be welded. This folding of the upper part of the covering, in the shape of the bottom of a paper bag, is obtained by the combined action of the fingers 29 with two heating blades 31 and 32, operating in a plane perpendicular to the direction of movement of the conveyor belt. These blades are actuated by jacks 33 and are substantially as long as the covering so as to weld the two edges $27_3$ and $27_4$ along their entire length with such welding being made along the median plane of the package.

At this stage, the package is closed and tightly wrapped on five of its six sides, and it only remains to connect the peripheral edge 14 of the base sheet 13 with the vertical walls of the covering to obtain a fully closed waterproof package.

The connection between the base sheet and the peripheral covering is obtained by raising the peripheral border 14 of the base sheet along the two lateral sides $14_1$ and $14_2$ (see FIG. 2) by means of a pair of guides 34, located on opposite sides of the conveyor belt. Such guides have helical configurations so that the threads progressively raise the two lateral sides $14_1$ and $14_2$ of the base sheet to a plane parallel to that of the covering 25. The two other edges $14_3$ and $14_4$ of the base sheet are also raised to a plane generally parallel to the covering by suitable mechanical means or streams of air located in a plane perpendicular to the conveyor belt.

The package is then moved to a sealing station having a retraction furnace 35. Such furnace has a high heat zone located adjacent to the lower part of the package, as indicated at 36 (FIG. 1), to seal the edge 14 of the base sheet to the lower portion of the vertical wall of the covering 25. The remainder of the furnace is provided with low heat zones which cause the heat retractable plastic film to shrink into intimate engagement with the articles.

The retracted cover binds the articles into a compact waterproof package without a pallet which allows it to be handled, piled and preserved due to the watertightness of the wrapping.

The retractable plastic material can be of any suitable thermoplastic material such as PVC, and the temperature of the retraction furnace for contracting the material without destroying its mechanical characteristics may vary from approximately 200° and 250° C.

What is claimed is:

1. A watertight palletless package for protecting a plurality of stacked articles comprising a pair of enlongated spaced generally parallel support members, a first flexible thermoplastic sheet overlying said support members and having a peripheral border, said first sheet being firmly adhered to the top surfaces only of said support member, said first sheet receiving a plurality of articles in stacked relationship inwardly of said peripheral border of said first sheet and supported by said support members, said peripheral border being turned upwardly along said articles, a second flexible thermoplastic sheet completely covering the vertical sides and the top of the articles, said second sheet having a lower edge sealingly engaging said upwardly turned peripheral border of said first sheet, and said first and second sheets being shrunk into intimate engagement with said articles, whereby said first and second sheets hold the articles in assmbled relationship and protect the same from the elements.

2. The package as defined in claim 1 in which said support members are of hollow tubular construction and are located in a position to receive the forks of a fork lift.

* * * * *